US010066395B2

(12) United States Patent
Stevanov

(10) Patent No.: US 10,066,395 B2
(45) Date of Patent: Sep. 4, 2018

(54) MODULAR ROOF STRUCTURE

(71) Applicant: Aleksandar Stevanov, Windsor (CA)

(72) Inventor: Aleksandar Stevanov, Windsor (CA)

( * ) Notice: Subject to any disclaimer, the term of this patent is extended or adjusted under 35 U.S.C. 154(b) by 0 days.

(21) Appl. No.: 14/970,446

(22) Filed: Dec. 15, 2015

(65) Prior Publication Data

US 2016/0201326 A1 Jul. 14, 2016

Related U.S. Application Data

(60) Provisional application No. 62/092,161, filed on Dec. 15, 2014.

(51) Int. Cl.

| | |
|---|---|
| ***E04B 1/38*** | (2006.01) |
| ***E04C 3/38*** | (2006.01) |
| ***E04C 3/11*** | (2006.01) |
| ***E04B 7/02*** | (2006.01) |
| ***E04H 1/12*** | (2006.01) |
| ***E04H 6/02*** | (2006.01) |
| *E04B 1/24* | (2006.01) |

(52) U.S. Cl.

CPC ..... *E04C 3/38* (2013.01); *E04B 7/022* (2013.01); *E04C 3/11* (2013.01); *E04H 1/1205* (2013.01); *E04H 1/1211* (2013.01); *E04H 1/1222* (2013.01); *E04H 6/025* (2013.01); *E04B 2001/2451* (2013.01)

(58) Field of Classification Search

CPC ..... E04C 3/38; E04C 3/02; E04C 3/11; E04H 6/025; E04H 1/1222; E04H 1/1211; E04H 1/1205; E04B 7/022; E04B 2001/2451

USPC ..... 52/2.18, 2.11, 2.22, 2.21, 481.1, 282.1, 52/731.2, 731.4

See application file for complete search history.

(56) References Cited

U.S. PATENT DOCUMENTS

| | | | | | |
|---|---|---|---|---|---|
| 2,151,908 | A * | 3/1939 | Gottlieb | E04B 1/3441 | 135/117 |
| 2,780,843 | A * | 2/1957 | De Sherbinin | E04B 1/3444 | 52/18 |
| 4,121,604 | A * | 10/1978 | Rain | E04H 15/36 | 135/118 |
| 4,583,333 | A * | 4/1986 | Minter | E04D 3/14 | 52/262 |
| 4,686,805 | A * | 8/1987 | Forslin | E04B 1/0046 | 49/DIG. 1 |
| 4,765,102 | A * | 8/1988 | Kuchem | E04B 1/0046 | 362/147 |
| 4,799,982 | A * | 1/1989 | Vicino | B28B 7/22 | 156/71 |
| 4,884,376 | A * | 12/1989 | DeBlock | E04B 1/0046 | 52/295 |

(Continued)

*Primary Examiner* — Brian E Glessner
*Assistant Examiner* — Joshua K Ihezie
(74) *Attorney, Agent, or Firm* — The Watson IP Group, PLC; Jovan N. Jovanvoic; Vladan M. Vasiljevic

(57) ABSTRACT

A post, beam and arched member modular building is shown. The modular building may be formed into any number of different configurations and different structures. The system relies upon a box shape formed from four vertical members, with an arched member extending between each of the adjacent vertical members. The rear vertical members being higher than the front vertical members, with angled members, or rafters extending from the rear vertical members (or a cross-member at the same height thereof) to the front vertical members (or the corresponding arch). In the configuration shown, the angled members or rafters are co-planar. The structure has substantial symmetry and aesthetic design.

13 Claims, 12 Drawing Sheets

(56) References Cited

U.S. PATENT DOCUMENTS 5,090,164 A * 2/1992 Mische ..... E04B 1/0046 49/DIG. 1
5,568,707 A * 10/1996 Ishikawa ..... E04B 1/0046 52/200
5,638,851 A * 6/1997 Baldwin ..... E04H 15/36 135/116
6,003,279 A * 12/1999 Schneider ..... E04B 1/0046 403/230
6,029,404 A * 2/2000 Lewis ..... E04B 9/06 52/2.11
6,155,280 A * 12/2000 Powell ..... E04H 15/18 135/119
6,929,016 B2 * 8/2005 Lee ..... E04H 15/20 135/126
8,082,700 B2 * 12/2011 Kennedy ..... E04B 1/3205 135/124
8,534,470 B1 * 9/2013 Lin ..... A47F 5/137 211/13.1
8,973,336 B2 * 3/2015 Edwards ..... E04B 7/08 52/2.15
D728,822 S * 5/2015 Ryan ..... A47F 5/137 D25/15
D729,945 S * 5/2015 Foreman ..... A47F 5/137 D25/16
9,243,422 B2 * 1/2016 Hunt ..... E04H 15/34
9,556,639 B2 * 1/2017 Hunt ..... E04H 15/16
2007/0261319 A1 * 11/2007 Fitzpatrick ..... E06B 1/006 52/80.1
2009/0217617 A1 * 9/2009 Kennedy ..... E04B 1/3205 52/781
2010/0058689 A1 * 3/2010 Campbell ..... E02D 27/02 52/270
2010/0213708 A1 * 8/2010 Esdaile ..... E04H 15/34 285/420
2011/0258941 A1 * 10/2011 Dalo ..... E04B 1/34315 52/11
2012/0291362 A1 * 11/2012 Milo ..... E04B 1/165 52/2.18
2012/0311941 A1 * 12/2012 Edwards ..... E04B 7/08 52/79.9
2014/0007521 A1 * 1/2014 McMahon ..... E04H 3/16 52/2.11
2014/0174284 A1 * 6/2014 Peters ..... F41H 5/24 89/36.02
2015/0315808 A1 * 11/2015 Cronk ..... E04H 15/34 135/121

* cited by examiner

MODULAR ROOF STRUCTURE

CROSS-REFERENCE TO RELATED APPLICATION

This application claims priority from U.S. Provisional Patent Application Ser. No. 62/092,161 filed Dec. 15, 2014, entitled "Modular Roof Structure," the entire specification of which is hereby incorporated by reference in its entirety.

BACKGROUND OF THE DISCLOSURE

1. Field of the Disclosure

The invention relates in general to modular roofing structures, and more particularly, to a post, beam and arched member modular building is shown.

2. Background Art

The making of structures is known in the art. Many such structures have deficiencies and drawbacks.

Attached in the drawing sheets are designs for a modular roofing structure that overcomes the deficiencies of the prior art.

BRIEF DESCRIPTION OF THE DRAWINGS

The disclosure will now be described with reference to the drawings wherein:

Drawing Sheet 1 is a schematic perspective rendering of a sample modular system of the present disclosure, showing in particular the various beams and support structures, as well as the modular configuration of the same;

Figure 1:
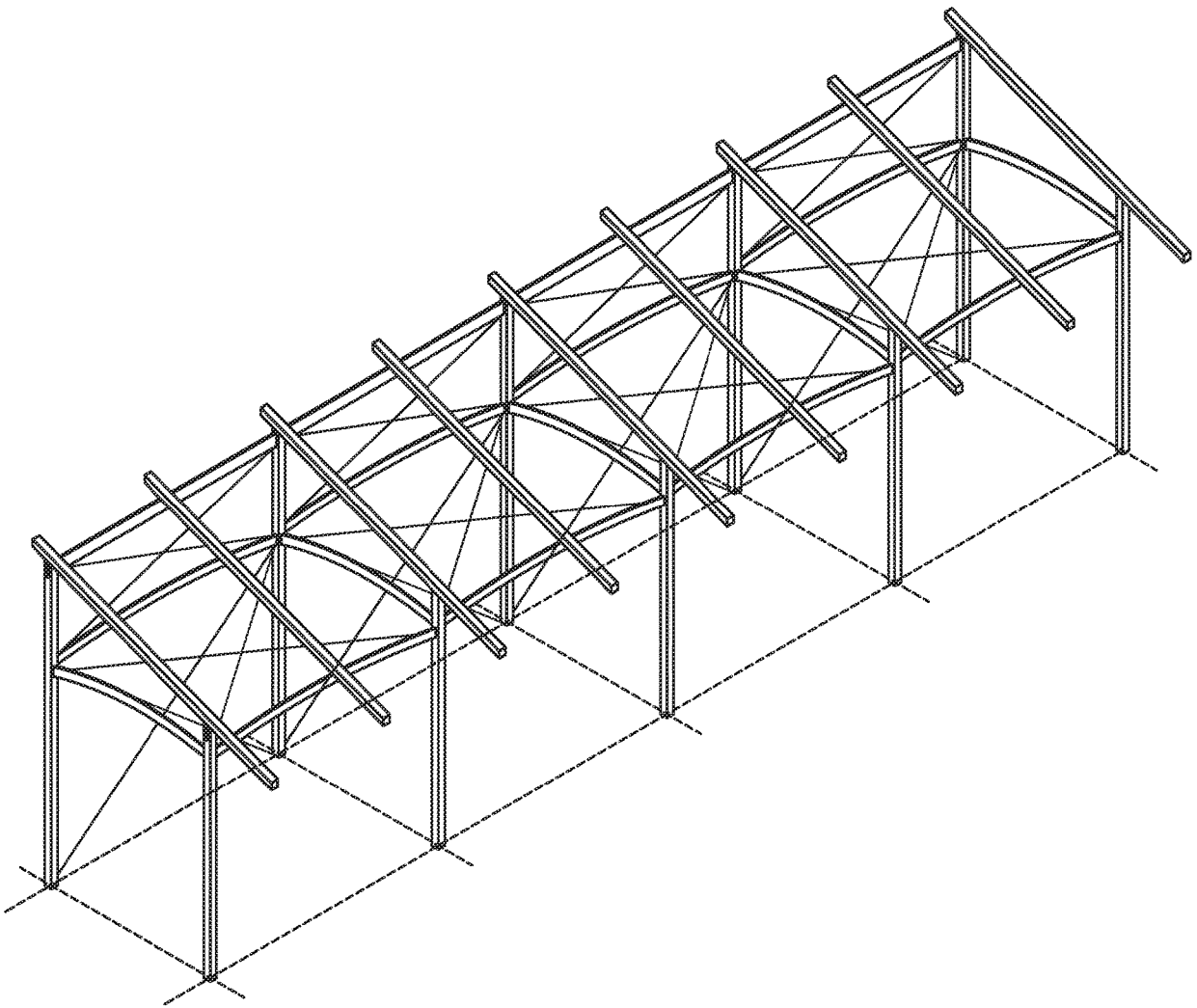
Figure 2:
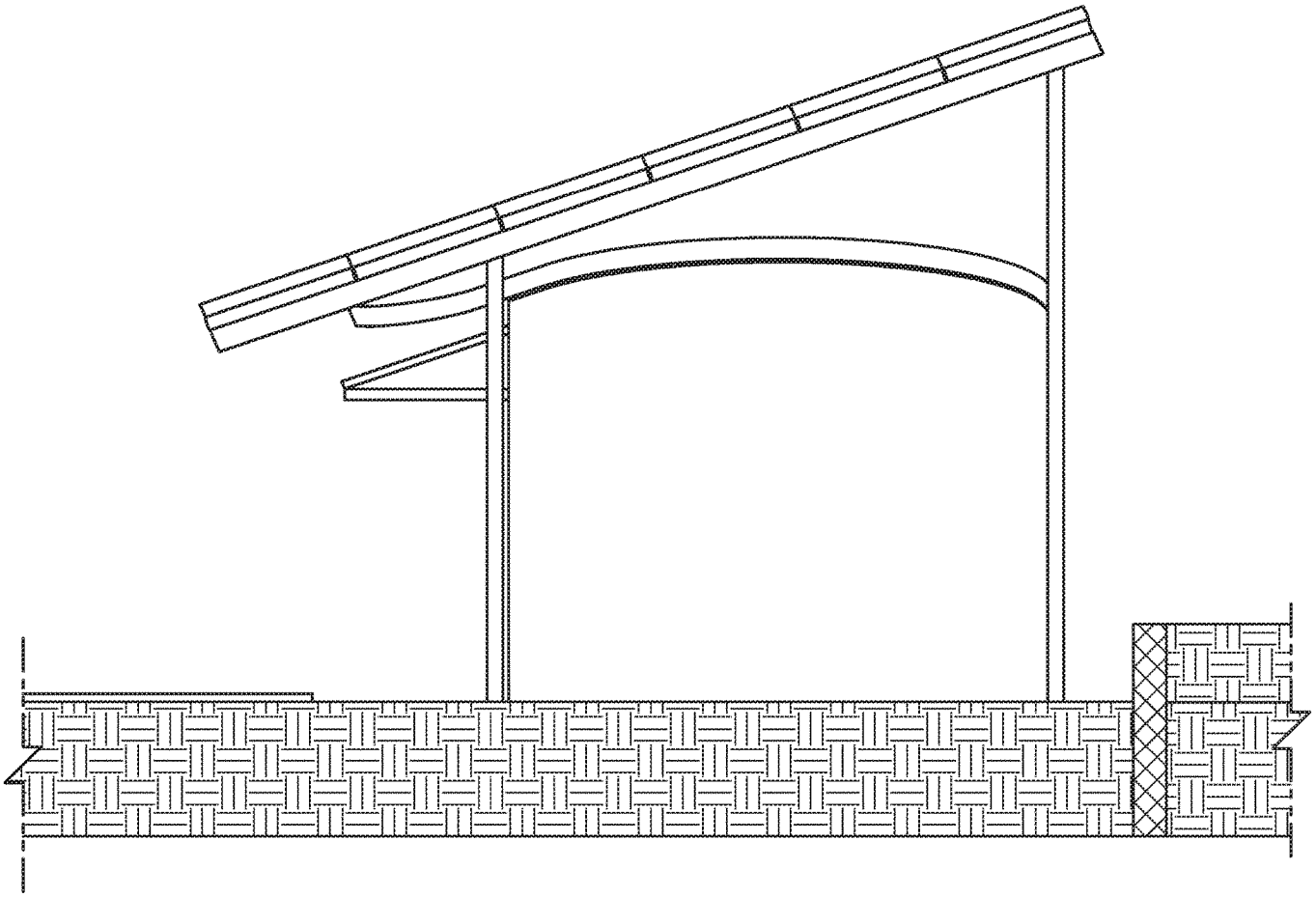
Figure 3:
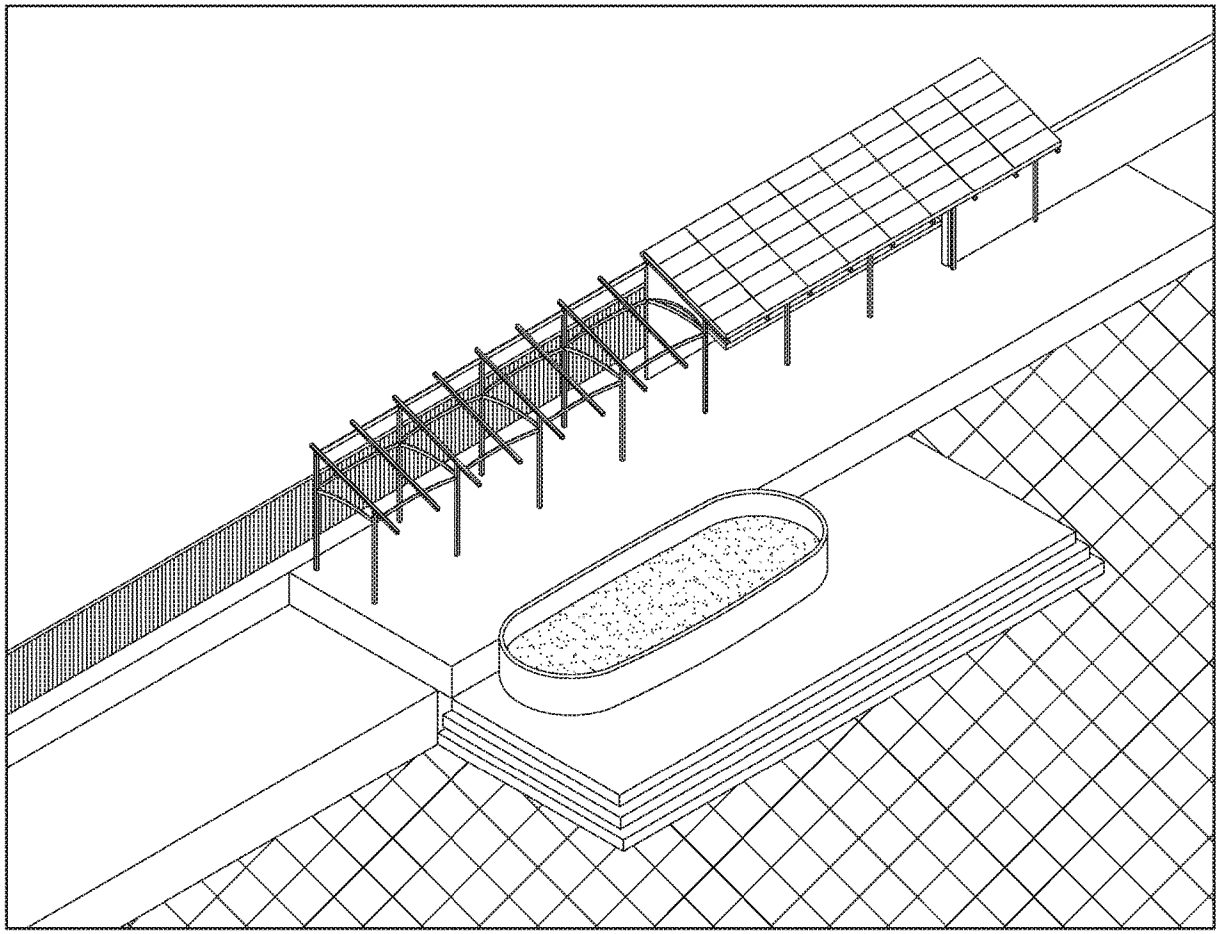
Figure 4:
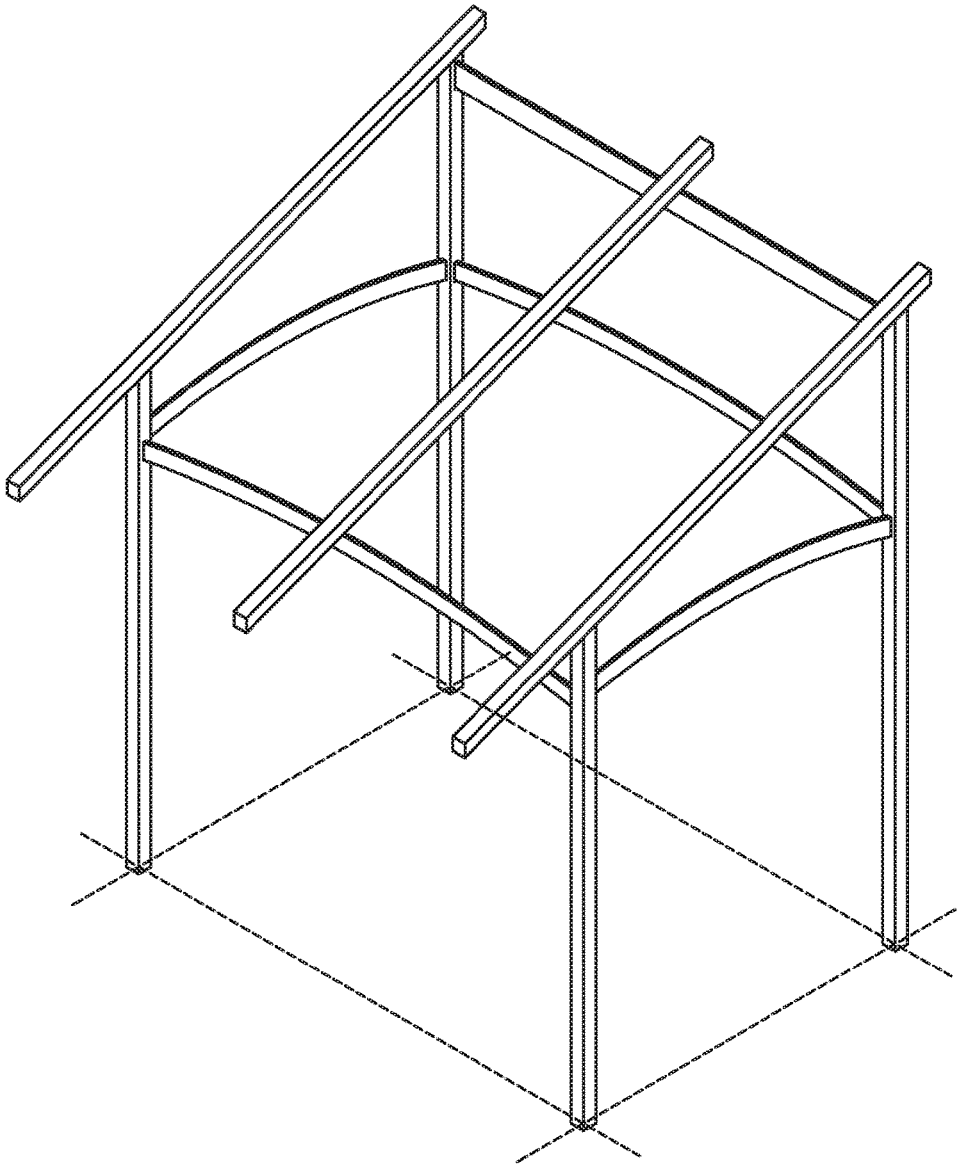
Figure 5A:
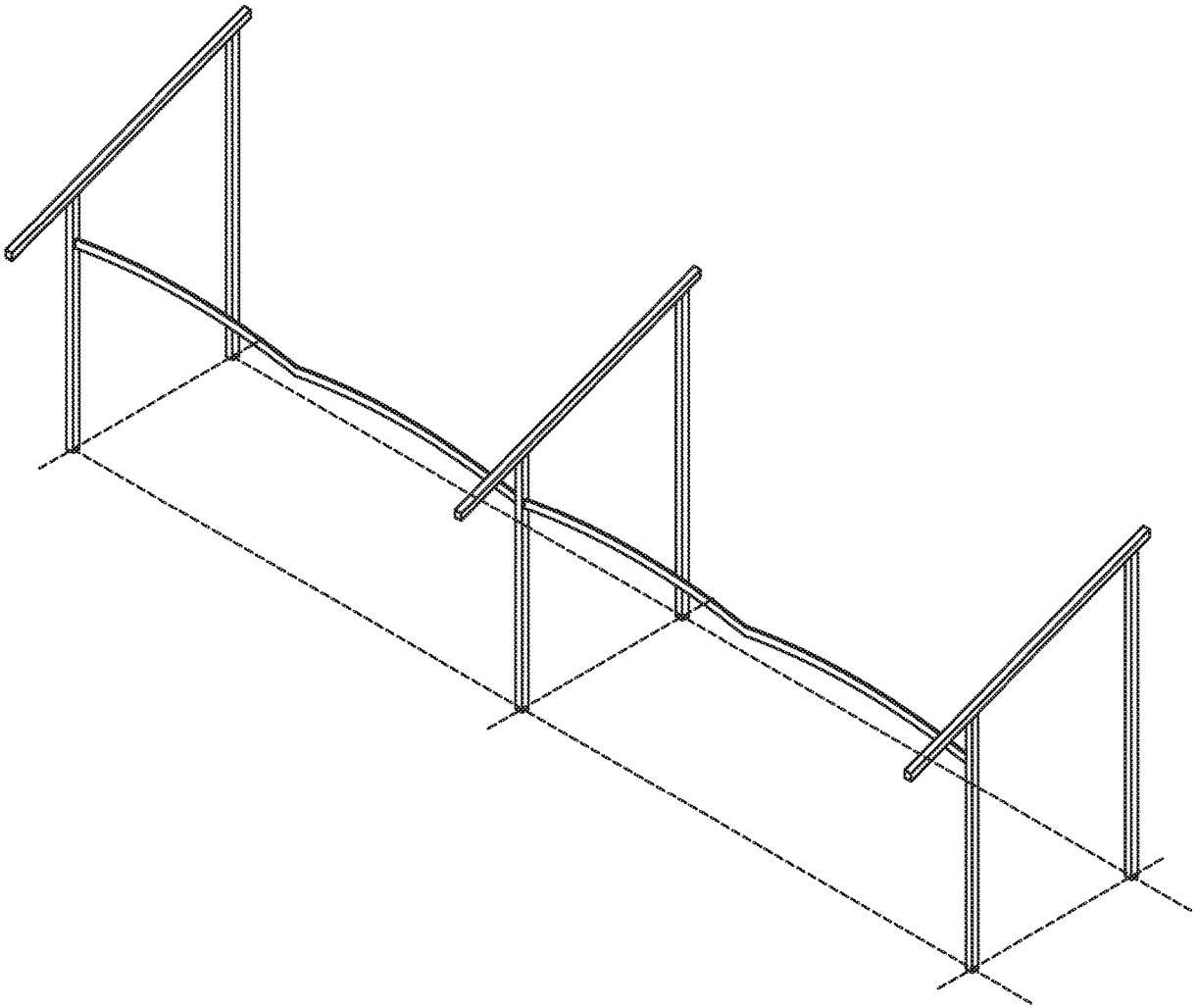
Figure 5B:
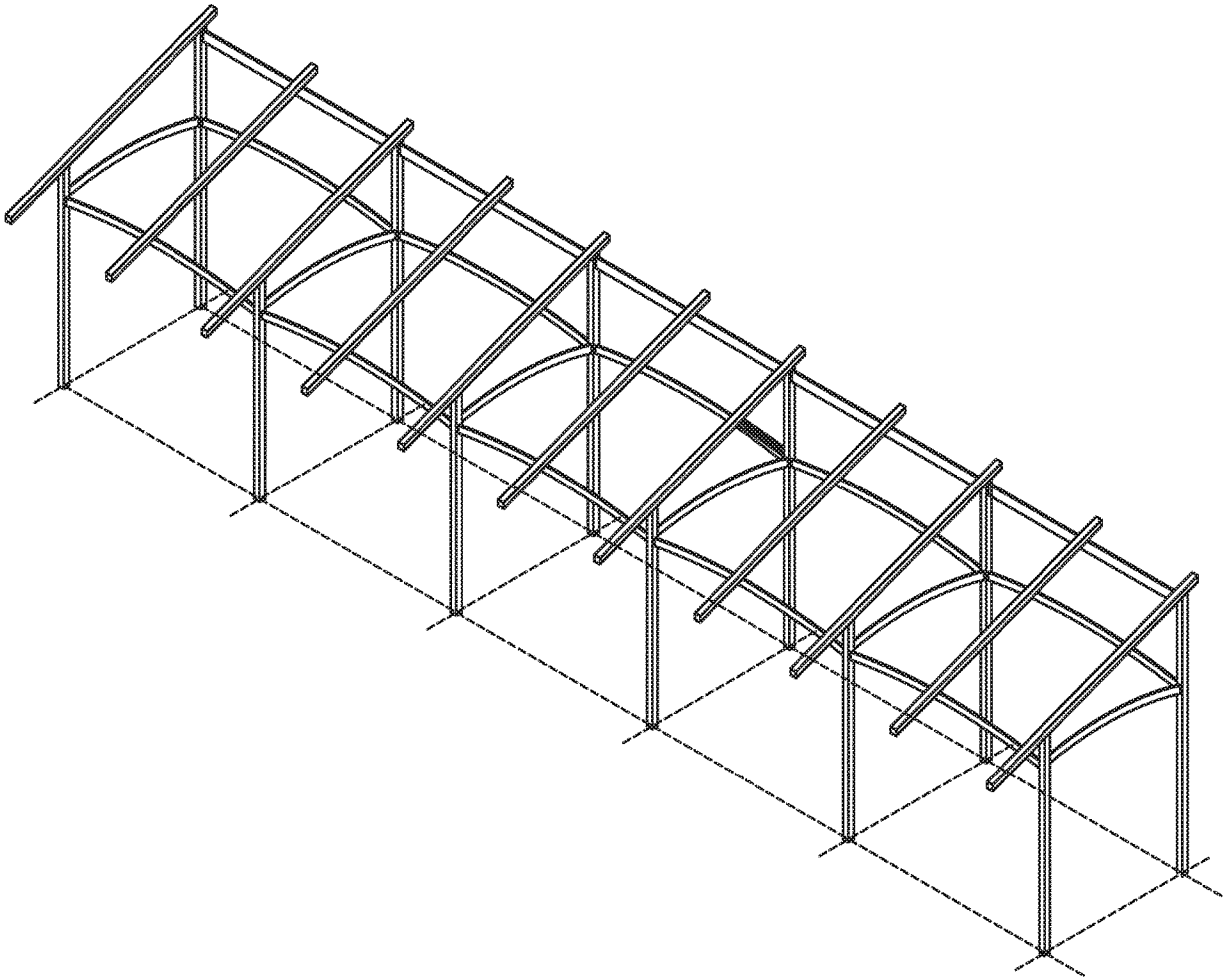
Figure 6:
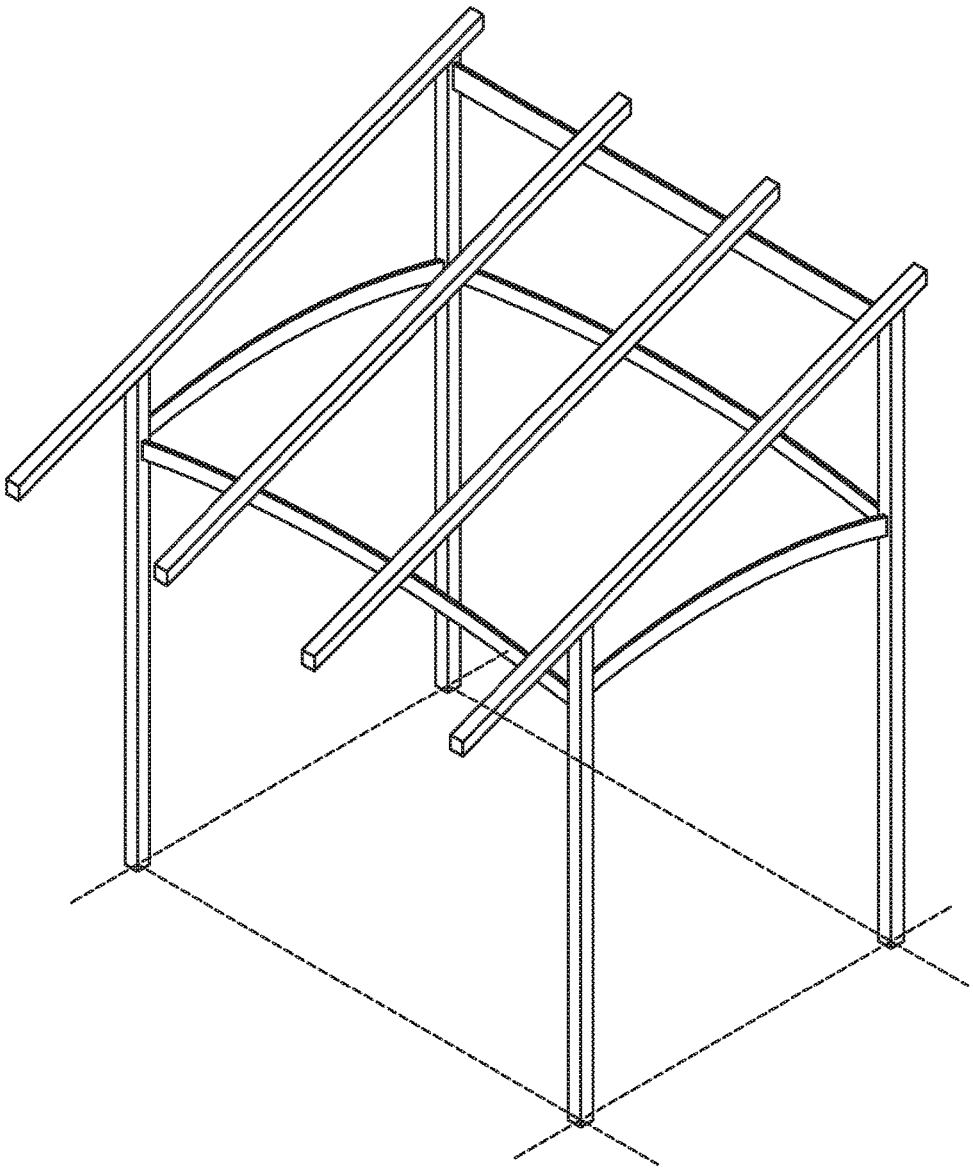
Figure 7:
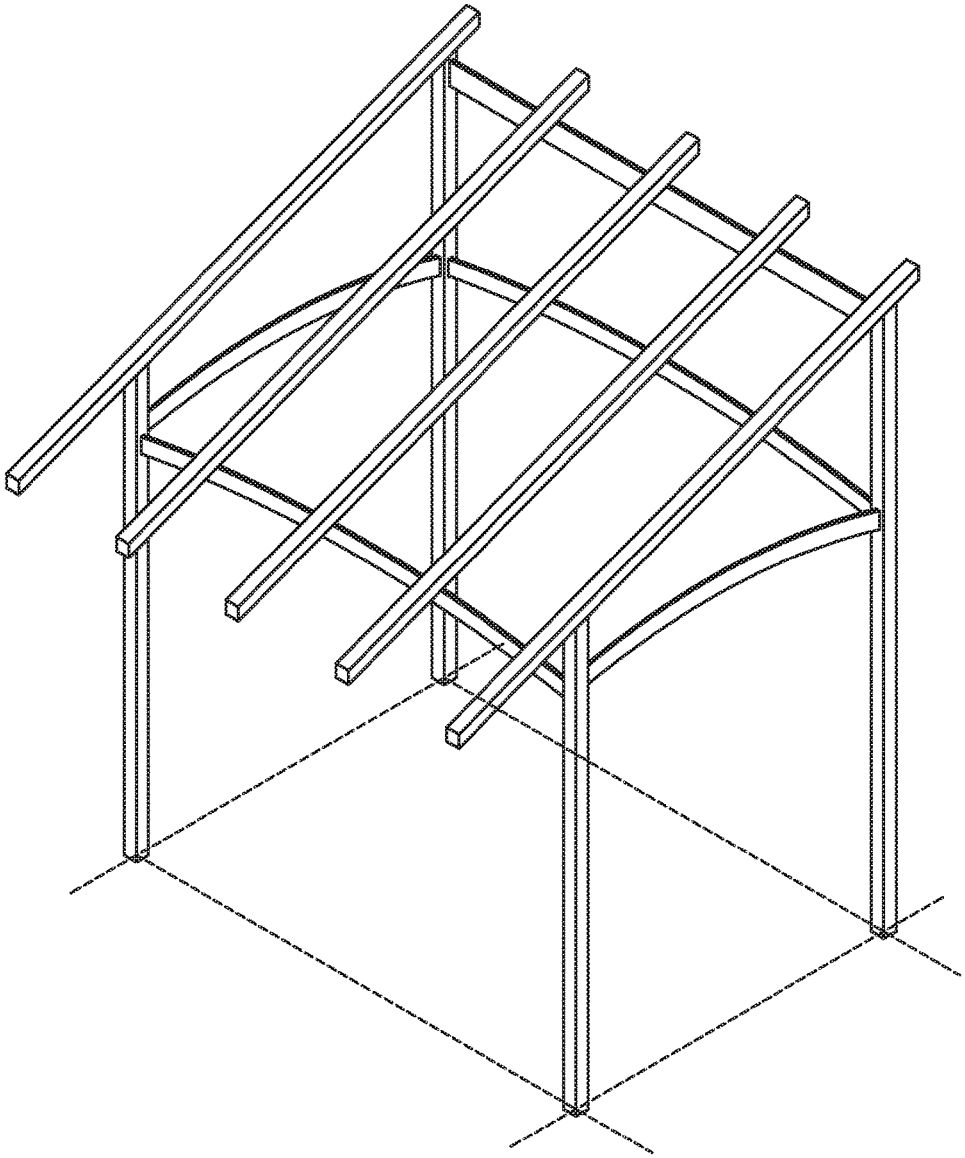
Figure 8:
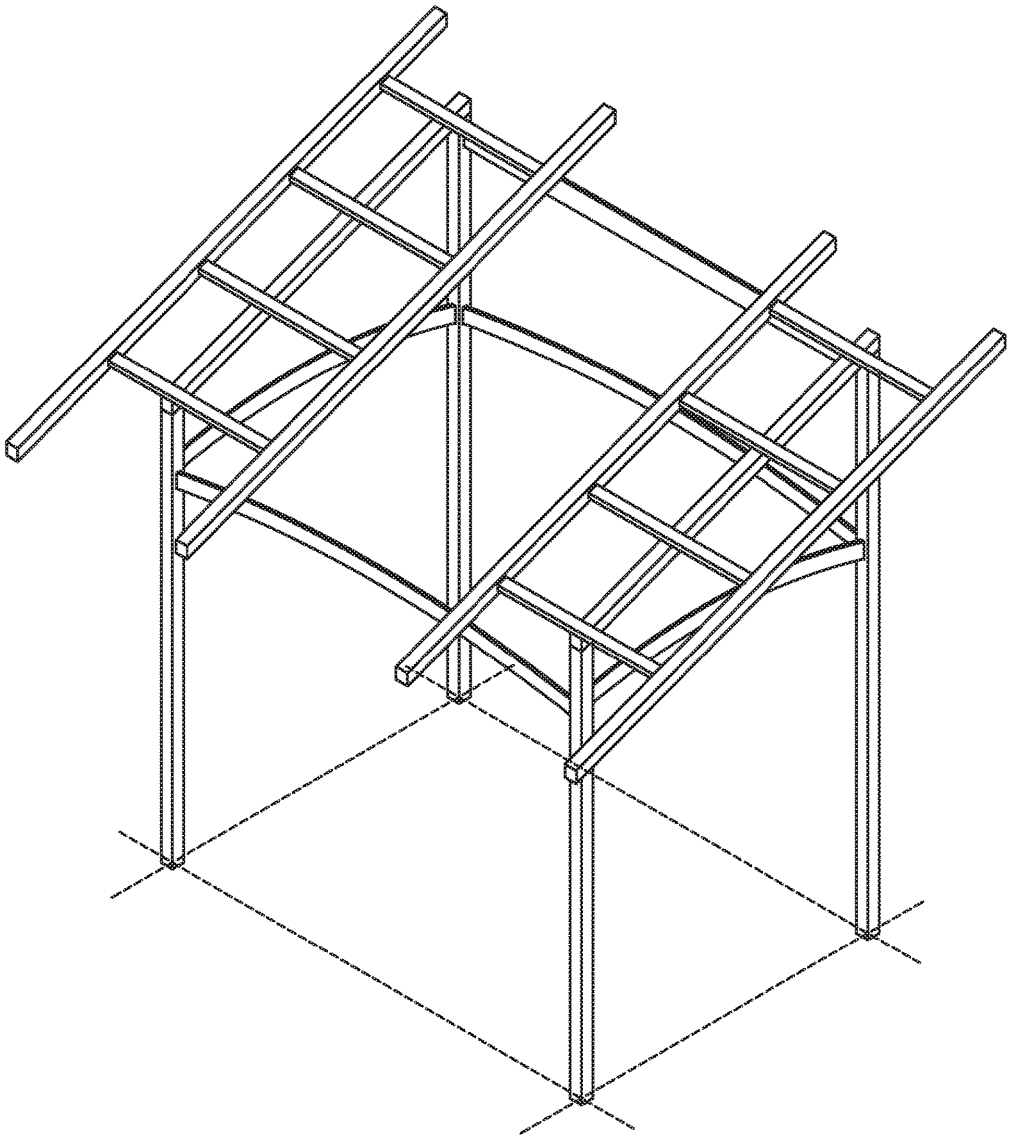
Figure 9:
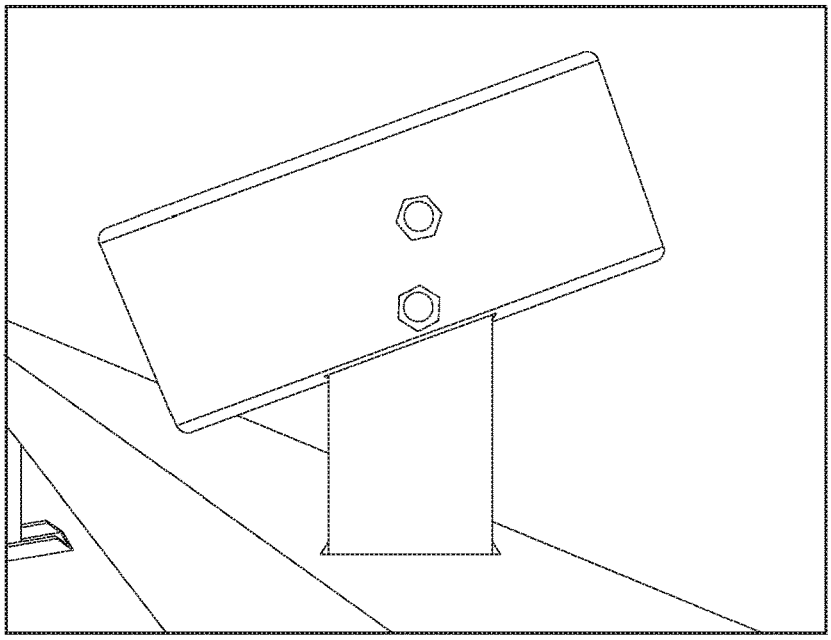
Figure 10:
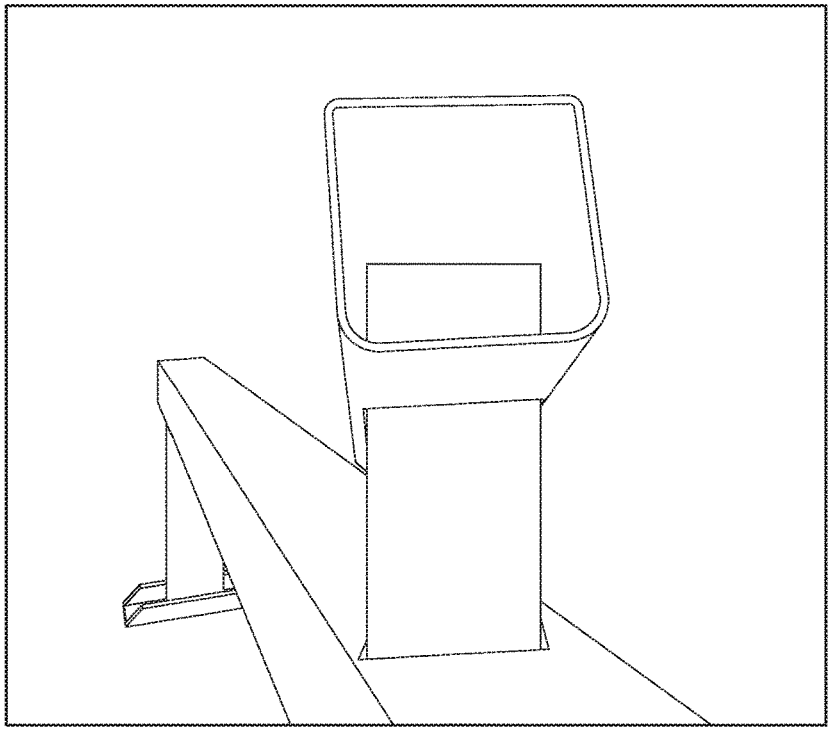
Figure 11:
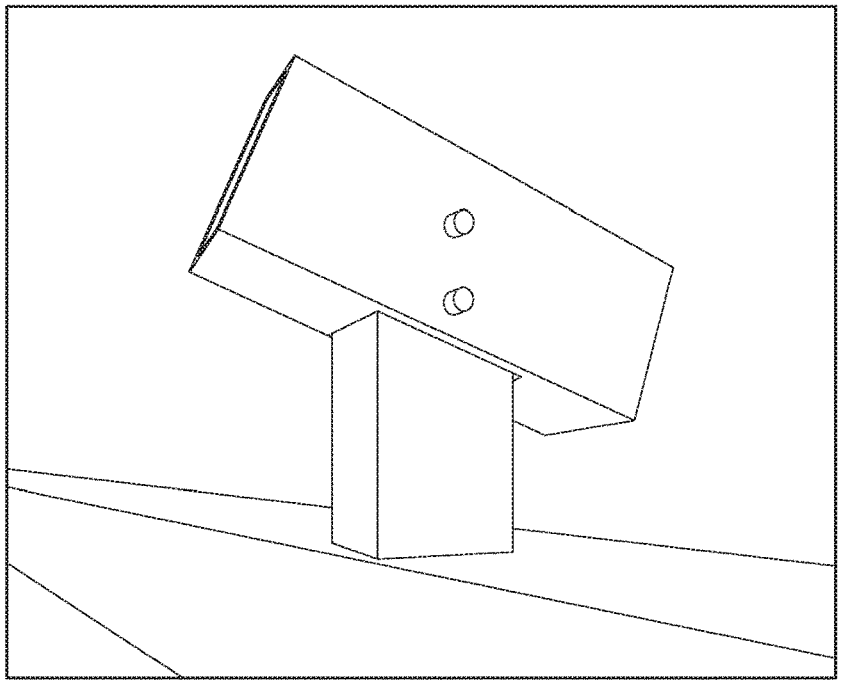
Figure 12:
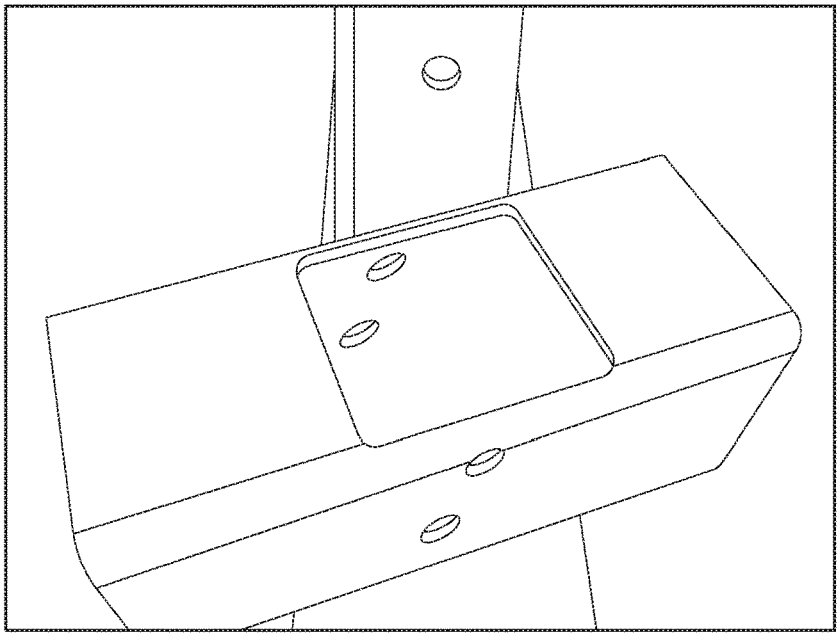

Drawing Sheet 2 is a side elevational view of a configuration of a sample modular system of the present disclosure;

Drawing Sheet 3 is a perspective rendering of a structure utilizing the modular system of the present disclosure;

Drawing Sheets 4 through 8 are each schematic perspective figures of the modular system of the present disclosure;

Drawing Sheets 9 through 12 are each photographs of different coupling structures for coupling the various components to each other; and Drawing Sheet 13 discloses a cap structure common in the industry which can be eliminated with the structures of the present disclosure.

DETAILED DESCRIPTION OF THE DISCLOSURE

While this invention is susceptible of embodiment in many different forms, there is shown in the drawings and described herein in detail a specific embodiment with the understanding that the present disclosure is to be considered as an exemplification and is not intended to be limited to the embodiment illustrated It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to Drawing Sheet 1, a post, beam and arched member modular building is shown. The system allows for the introduction of adjacent units on a modular basis that may form the basis of any number of different buildings. Additionally, solar performance roofing (which is disclosed in a presently pending application, namely, U.S. Prov. Pat. App. Ser. No. 62/087, 151, filed Dec. 3, 2014, entitled "Roof Panel System", the entirety of which is hereby incorporated by reference in its entirety). Such a system can be utilized in association with any number of structures, including, but not limited to car ports, golf cart tee of shade shelters and cart charging areas, bus shelters, sheds, gazebos and pavilions, beach shacks, lean-to's, dug out structures, poolside cabanas and vending booths, to name a few.

As can be seen in the attached drawings, and especially in drawing sheets 1, 4, 5, 6, 7 and 8 each module includes a plurality of front vertical elements, and a plurality of rear vertical elements. The front elements are shorter than the rear elements. They are generally positioned in a square or rectangular configuration, generally parallel to each other and equidistantly spaced apart. An arched member extends between each of the adjacent members so as to define an arched square. A cross member extends between the two rear elements generally at the top thereof and perpendicular thereto. Thus, it is spaced apart from one of the arched members therebelow.

Three separate angled members extend from the rear to the front. The two outer angled members extend from the rear vertical element to the front vertical element spaced apart from the respective arched members. A third angled member extends from the cross member (equidistantly spaced apart from the adjacent rear vertical elements) to the top of the arched member that extends between the two front elements. It will be understood that due to the configuration and placement of the arched member, the three angled members all lie in the same plane.

It will be understood that the system is modular in that additional pairs of vertical members (i.e., a rear vertical member and a front vertical member may be spaced apart and added. Additional arched members and angled members may be provided to form adjacent squares that share an arched member, an angled member, a front vertical element, and a rear vertical element.

The angled members may comprise beams, or may comprise the supports for the roofing system shown and described in the referenced co-pending provisional application.

It will be understood as well that connectors and braces may be provided (which may comprise cables, threaded rods and the like) to enhance the strength of the system, and to maintain the system in the proper configuration (i.e., to enhance the rigidity and integrity of the system).

With reference to drawing sheet 2, the angled members extend beyond the rear vertical members and beyond the front vertical members. It will be understood that in the embodiment shown, the angled members extend beyond the front vertical members to create a larger overhang. Additional structures for aesthetics, or for additional functionality may be added.

Drawing sheet 3 discloses a pool house and adjacent pergola formed from the modular system. As can be seen, four modular squares are shown to form the pergola, with an additional four modular squares defining an enclosure. The roof of the enclosure is formed from a plurality of solar cells that can provide electricity for the installation, as well as excess energy that can be transferred to the electricity distribution grid.

Figure 13:
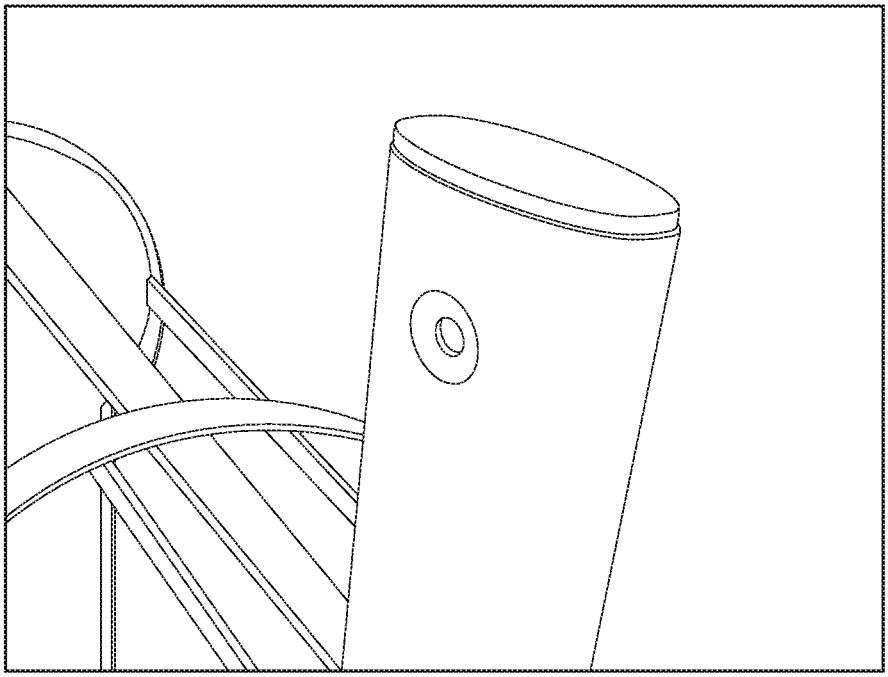

With reference to drawing sheets 9 through 12, these disclose and help to explain the mating structures for connecting the angled members, the vertical members and the arched members. That is, the rood rafters slide down over the columns to cap the same over a stub atop the arched member. The connections are configured to be sleek and concealing. The arched members slide over a stub which also provides a concealed connection. In the figures shown, a rafter with a hole cut thereinto is slipped over a column to make a concealed joint or connection. The connection appears as very similar to a cope cut. This may reduce a number of steps in the fabrication. The angled member (i.e., the rafter) caps the column. Additional shims may be affixed to the female part or onto the male part depending on the degree of perfection being sought in the connection. The shims prevent the outer member from squeezing and warping the other member. Such a connection provides ease of assembly, ease of shipping, and provides fewer components and caps (such as the cap shown in FIG. 13).

It will be understood that a single angled member is shown to extend from the crossing member to the arch between the front vertical members. In other embodiments, the arches may extend higher, and, as such, a pair of angled members may be spaced apart from the ends so that they extend to the arch between the front vertical members on either side of the vertex of the arch. It will be understood that the spacing of the angled members can be determined by the sizing and dimensions of any roofing material utilized (including any solar panels, and the like).

A number of variations are contemplated, and further provisional applications as well as the conversion application will serve to provide additional disclosure of these different embodiments.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A modular building structure comprising:

at least four substantially vertical elements spaced apart from each other to form a generally square configuration, at least two defining front vertical elements and at least two defining rear vertical elements, with the rear vertical elements being longer than the front vertical elements;

a rear cross-member extending between the at least two rear vertical elements, generally perpendicular to the at least two rear vertical elements, proximate an upper end of the at least two rear vertical elements;

at least four arched members that are substantially identical in configuration extending between the adjacent ones of the at least two rear vertical elements and the at least two front vertical elements, each of the arched members being substantially identical in dimension and having a first end and a second end, with an upwardly convex arch therebetween, with the first end and the second end mounted so as to define an axis which is substantially perpendicular to the at least four substantially vertical elements, with a highpoint of the upwardly convex arch being positioned at a midpoint between the first end and the second end thereof, with the at least four arched members defining a substantially square configuration, and with the first and second ends being spaced apart from the upper end of the at least two rear vertical elements and at an upper end of the at least two front vertical elements;

at least three angled members, a first of the at least three angled members extending from the upper end of one of the at least two rear vertical elements to an upper end of one of the at least two front vertical elements, and spaced apart from a one of the at least four arched members that spans between the at least two front vertical elements, a second of the at least three angled members extending from the upper end of another one of the at least two rear vertical elements to an upper end of another one of the at least two front vertical elements, and spaced apart from the one of the at least four arched members that spans between the at least two front vertical elements, and a third of the at least three angled members extending from the rear cross-member to the highpoint of the upwardly convex arch of the one of the at least four arched members that spans between the at least two front vertical elements, wherein the first, second and third of the at least three angled members are parallel to each other and collectively define a plane, while only the third of the at least three angled members contacts the one of the at least four arched members that spans between the at least two front vertical elements, and wherein the highpoint of the upwardly convex arch matches a highpoint of each of the front vertical elements, wherein the at least three angled members extend beyond the upper end of the at least two front vertical elements, and beyond the upper end of the two rear vertical elements, defining a front overhang and a rear overhang, with the front overhang being longer than the rear overhang.

2. The modular building structure of claim 1, wherein the rear cross-member is positioned at the upper end of the at least two vertical elements.

3. The modular building structure of claim 1 wherein the at least three angled members extend beyond the rear cross-member, opposite the at least two front vertical elements.

4. The modular building structure of claim 3 wherein the at least three angled members extend beyond the at least two front vertical elements, opposite the at least two rear vertical elements.

5. The modular building structure of claim 4 wherein the at least four arched members are substantially co-planar with a plane formed by the two vertical elements of the at least four vertical elements to which the one of the at least four arched members is coupled.

6. The modular building structure of claim 1 wherein the first and third ones of the at least three angled members include a bore extending therethrough defining an elongated passageway, and a transverse opening extending into the bore, the transverse opening sized to facilitate the insertion of at least one of the at least four vertical elements therethrough, so as to be coupled together.

7. The modular building structure of claim 1 wherein the third one of the at least three angled members is positioned equidistantly spaced apart from the first one of the at least three angled members and the second one of the at least three angled members.

8. The modular building structure of claim 7 wherein a fourth one of the at least three angled members is positioned between the first one of the at least three angled members and the third one of the at least three angled members.

9. The modular building structure of claim 8 wherein a fifth one of the at least three angled members is positioned between the second one of the at least three angled members and the third one of the at least three angled members.

10. The modular building structure of claim 9 wherein each of the at least three angled members define a plane.

11. The modular building structure of claim 10 wherein each of the at least three angled members are positioned so as to be parallel to each other.

12. The modular building structure of claim 11 wherein each of the at least three angled members are equidistantly positioned relative to each other.

13. The modular building structure of claim 1 wherein additional vertical elements can be added in pairs, and additional angled members can be added along with additional rear vertical elements, to, in turn, copy the same structure.

* * * * *